United States Patent [19]

Smyser

[11] Patent Number: 4,746,327

[45] Date of Patent: May 24, 1988

[54] ETHYLENE-UNSATURATED, ESTER-SUBSTITUTED OLEFIN TERPOLYMER FLOW IMPROVERS

[75] Inventor: Granville L. Smyser, Plainfield, Ill.

[73] Assignee: Standard Oil Company (Indiana), Chicago, Ill.

[21] Appl. No.: 715,628

[22] Filed: Mar. 25, 1985

[51] Int. Cl.[4] ..... C10L 1/14

[52] U.S. Cl. ..... 44/62; 44/70

[58] Field of Search ..... 44/62, 70

[56] References Cited

U.S. PATENT DOCUMENTS

| | | | |
|---|---|---|---|
| 4,146,489 | 3/1979 | Stambaugh et al. | 44/62 |
| 4,160,459 | 7/1979 | Sweeney | 44/62 |
| 4,178,950 | 12/1979 | Sweeney | 44/62 |
| 4,362,533 | 12/1982 | Kidd | 42/62 |
| 4,404,000 | 9/1983 | Toyoshima et al. | 44/62 |

*Primary Examiner*—William R. Dixon, Jr.
*Assistant Examiner*—Margaret B. Medley
*Attorney, Agent, or Firm*—James R. Henes; William H. Magidson; Ralph C. Medhurst

[57] ABSTRACT

An ethylene-unsaturated, ester-substituted olefin distillate flow improver and cold-flow plugging point improvers are disclosed.

3 Claims, No Drawings

ETHYLENE-UNSATURATED, ESTER-SUBSTITUTED OLEFIN TERPOLYMER FLOW IMPROVERS

This invention relates to distillate petroleum products containing additives which improve the temperature-viscosity properties, including low-temperature flowability, cold-flow plugging point, and pour point characteristics, of distillate petroleum products. More particularly, this invention relates to distillate petroleum products having improved low-temperature properties, comprising a distillate fuel and an effective amount of an ethylene-unsaturated, ester-substituted olefin terpolymer at a concentration sufficient to substantially prevent thickening of the petroleum product and crystallization of large wax particles than can clog lines and filters at low temperatures.

The low temperature-viscosity properties of petroleum distillate fuels boiling between about 250° F. and 950° F. have attracted increasing attention in recent year. Markets for these fuels have grown in arctic, subarctic, and adjacent areas experiencing low temperatures. Commerical jet aircraft are now capable of attaining operating altitudes where the ambient temperatures may be −50° F. and below. This invention is of particular interest in connection with the use of gasoline, jet fuels, kerosenes, diesel fuels, fuel oils, naphthas, gas oils, such as light virgin gas oil, and fuel oils at low temperatures and in domestic, North American, European, and Northern Asian applications.

Distillate petroleum products having relatively high pour points have serious cold weather drawbacks. For example, distribution of the distillate by pumping for siphoning is difficult or impossible at temperatures at or near the pour point. Furthermore, in applications such as engines or home burner installations at or near the pour point, the flow of the fuel through filters cannot be maintained, leading to the failure of equipment to operate. At low temperatures large wax particles can form in the fuel and the fuel can become so thickened that transfer of petroleum products through transfer lines from container to container or from container to use is impossible. Commonly, polymeric additives are used to improve the viscosity-temperature properties of the petroleum product.

While many polymeric additives have been discovered which improve the viscosity-temperature properties of some distillates, few polymeric additives are effective in all the distillate compositions available today. Both the distillation range and crude source of the distillate product cause variation in the composition and properties of fuels. Additive compositions that improve paraffinic fuels often do not improve aromatic fuels. Additives effective in distillate fuels with low distillation end points commonly are not always effective in improving high distillation end point fuels. Fuels having relatively high distillation end points, for example, in excess of 640° F., are believed to contain a higher proportion of certain heavier n-paraffins or waxy hydrocarbons which cause the fuel to behave in a manner different than fuels with lower distillation end point temperatures, e.g., below about 640° F., in the presence of low temperature-viscosity-improving polymeric additives. For example, fuel oil and diesel oil produced in European refineries commonly have compositions different than comparable diesel and fuel oils produced in the United States. Cold-flow-improving polymers optimized for performance in domestic American fuels commonly do not produce equivalent improvement in the cold-flow characteristics in European fuels. The trend in production of domestic American fuels is to increase the distillation end point temperature to increase the yields of fuel. This trend tends to make the production of European-type fuels more common in the United States. Similarly, distillates derived from naphthenic crude oil generally have substantially different proportions of wax and other heavy hydrocarbons than found in distillates derived from aromatic or paraffinic crudes. Furthermore, polymeric materials that improve the flowability of distillates often do not improve the plug point characteristics of the distillate.

Ethylene-based polymers effective as pour point depressants, low-temperature-flowability improvers or as cold-flow plugging point improvers in distillate fuels include ethylene-vinyl acetate, ethylene-acrylate, ethylene-methacrylate, hydrolyzed ethylene-vinyl acetate, ethylene-alpha olefin, ethylene-vinyl fatty acid, ethylene-dialkylvinylcarbinol, etc. Ethylene-based terpolymers including ethylene and two or more other monomers that have been discovered include ethylene-styrene-acrylate and methacrylate; ethylene-styrene-vinylcarbinol; ethylene-vinyl acetate-unsaturated fatty acid; and ethylene-vinyl acetate-dialkyl maleate.

Included in the above polymers are ethylene-based copolymers containing alpha-olefins having 3–22 or more carbon atoms. Specific examples of ethylene-alpha-olefin copolymers are found in Cohen, U.S. Pat. No. 3,958,552, which discloses ethylene-alpha-monoolefin copolymers wherein the monoolefin has 10 to 22 carbon atoms; Burkard, U.S. Pat. No. 3,645,704, which discloses halogenated copolymers comprising ethylene and $C_3$–$C_6$ alpha-olefins; Ilnickyj, U.S. Pat. No. 3,640,691, which teaches ethylene-alpha-monoolefin copolymers; Rossi, U.S. Pat. No. 3,926,579, which teaches a blend of two polymers of alpha-olefins wherein one polymer comprises co-polymerized $C_{18}$–$C_{40}$ alpha-olefins and the other polymer comprises polymerized $C_3$–$C_{16}$ alpha-olefins; and Aaron, et al., U.S. Pat. No. 3,841,850, which teaches copolymers of ethylene and substituted ethylenes including unsaturated esters, unsaturated acids, anhydrides, amides, hydroxy compounds, and nitriles, each containing from 3–40 carbon atoms. Specifically, acrylic acid, methacrylic acid, and esters, unsaturated amides, unsaturated monohydroxy compounds, ethylenically unsaturated amines and nitriles as well as alpha-olefins are taught.

Many of the copolymers and terpolymers discussed above suffer the disadvantage that they provide either limited cold flow improvement in distillates or heavy hydrocarbons such as crudes, heavy gas oils, and synthetic oils, or that the copolymers and terpolymers fail to give economically significant cold-flow-improving properties to distillate fuels derived from different crude oils having distillation end point temperatures below about 640° F. or distillation end point temperatures greater than 640° F.

For economic reasons and for ease of operations, polymeric additives which effectively reduce the pour point and cold flow plugging point of fuels of different boiling ranges and compositions and which have the highest activity in each fuel are desired. Additives appear to prevent low-temperature flow problems and to inhibit wax crystal formation by a mechanism in which the polymeric additive, with a polymethylene backbone and various side chains, is absorbed onto a growing wax crystal surface. A portion of the polymeric side chain resembles the crystal structure to the extent that the polymer is absorbed and bound to the crystal surface. Other side chains are dissimilar to the crystal structure preventing further growth of the crystal by blocking the absorption of additional wax molecules. In other words, additional wax molecules no longer fit the crystal surface altered by the shape and position of the polymer side chains. The wax crystals are thereby kept very small and, as such, do not cause low-temperature-flowability problems.

Clearly, a need exists for a highly effective polymeric viscosity-temperature-improving additive which will improve the low-temperature flowability, cold-flow plugging point, and pour point of a variety of distillate fuels.

The principal object of this invention is to economically prevent thickening of distillates and crystallization of wax particles in distillates at low temperatures by the addition of highly effective novel polymeric additive compositions at low concentrations. Another object of this invention is to provide polymeric additives providing anti-crystallization and anti-thickening activity at low concentrations to a variety of distillate fuels having various compositions and boiling ranges. A further object of this invention is to improve the low-temperature flowability, cold-flow plugging point, and pour point of a variety of distillates with a polymeric additive. Further objects appear hereinafter.

We have now found that the objects of our invention can be obtained with an ethylene-unsaturated, ester-substituted olefin terpolymer. The presence of an effective viscosity-temperature-improving amount of the substituted olefin monomer in the polymer is critical to attain maximum performance from the polymer. While we do not wish to be held to a theory of effect of the substituted olefin on the properties of the terpolymer, we believe that the increased performance of the terpolymer is caused by the effect of the bulky olefin substituents on the conformation of the polymer chains in the distillate solution. In the absence of substituents on the substituted olefin, the polymer chains tend to be coiled and reduced in size. In the presence of substituted olefins having substituent groups, the polymer chains tend to be elongated. As such, the polymers tend to be more effective in preventing crystal growth in a greater area on each wax crystal. The greater elongation of the polymer chains both produces an increase in the effectiveness of each polymer chain and permits a reduction in the concentration of the polymer producing improved low-temperature flowability properties.

Briefly, the polymeric flow improvers of this invention comprise ethylene-unsaturated, ester-substituted olefin terpolymer.

Substituted olefins useful in producing the ethylene-unsaturated, ester-substituted olefin terpolymer of this invention have the characteristic that at least one unsaturated carbon has two substituents having the following general formula:

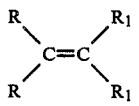

wherein each R is independently selected from substantially alkyl or substantially aryl groups and each $R_1$ is independently selected from hydrogen or R. The olefin substituents comprise substantially hydrocarbyl or alkyl groups containing saturated or unsaturated carbon atoms. Examples of the alkyl substituents are methyl, ethyl, isopropyl, tertiary butyl, 1,1,3-trimethylbutyl, 2-ethylhexyl, 1,3,5,7,9-pentamethyldecyl, 2,2-methylbutyl, 2,2,4,4-tetramethylpentyl, tertiary eicosyl and n-eicosyl. Also contemplated within the invention are unsaturated substituents such as vinyl, 1-methylvinyl, 2-methylvinyl, 2-butenyl, cyclohexenyl, methylcyclohexenyl, or eicosenyl.

Examples of useful substituted olefins include isobutylene (2-methyl propene), 2-ethyl-propene, 2-isobutyl-1-butene, 1,3-butadiene, 2-n-butyl-pentene, 2-methyl-1-octene, 3-ethyl-2-octene, 3-t-butyl-2-hexene, etc. Preferably, for reasons of availability, low cost, high activity, and ease of reactivity, the substituted olefin comprises isobutylene (2-methyl-1-propene), or isobutylene oligomers, including diisobutylene isomers (2,4,4-trimethyl-1-pentene or 2,4,4-trimethyl-2-pentene or mixtures thereof), triisobutylene isomers (2,4,4,6,6-pentamethyl-1-heptene, 2,4,4,6,6-pentamethyl( 2-heptene, cis- and trans-2,2,4,6,6-pentamethyl-3-heptene, or 2-neopentyl-4-4-dimethyl-1-pentene or mixtures thereof), tetraisobutylene isomers, etc. Substituted olefins, such as oligomers of isobutylene containing more than about 10 carbon atoms in the substituent, can be used, but with somewhat poorer performance due to steric effects reducing the polymerization rate and polymer molecular weight.

Unsaturated esters polymerizable with ethylene and the substituted olefins include unsaturated mono- and diesters of the general formula:

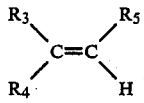

wherein $R_3$ is hydrogen or methyl; $R_4$ is a —$OOCR_6$ or —$COOR_6$ group wherein $R_6$ is a hydrogen or a $C_1$ to $C_{16}$, preferably a $C_1$ to $C_4$ straight or branched chain alkyl group; and $R_5$ is hydrogen or a —$COOR_6$. The monomer, when $R_3$ and $R_5$ are hydrogen and $R_4$ is —$OOCR_6$, includes vinyl alcohol esters of $C_2$ to $C_{17}$ monocarboxylic acids, preferably $C_2$ to $C_5$ monocarboxylic acids including vinyl acetate, vinyl isobutyrate, vinyl laurate, vinyl myristate, vinyl palmitate, etc. When $R_4$ is —$COOR_6$, such esters include methylacrylate, methyl methacrylate, lauryl acrylate, palmityl acrylate, palmityl methacrylate, and $C_{13}$ oxo alcohol esters of methyacrylic acid. Examples of monomers where $R_3$ is hydrogen and $R_4$ and $R_5$ are —$COOR_4$ groups, include mono- and diesters of unsaturated dicarboxylic acid such as mono-$C_3$-oxofumarate, di-$C_{13}$-oxofumarate, diisopropylmaleate, dilaurylfumarate, ethylmethylfumarate, etc. Preferably, for low cost and high activity, the unsaturated ester comprises vinylacetate, alkylacrylate, alkylmethacrylate, and dialkyl fumarate wherein the alkyl groups are straight or branched chain and have 2–17 carbon atoms.

As indicated above, polymers with side chains that resemble wax crystal structures and at the same time have side chains which are dissimilar to wax crystals are desired. The dissimilar side chains provided by the unsaturated esters present in the molecule poison the crystal growth. The ethylene and substituted olefin moieties in the polymer chain both resemble wax crystals and, at the same time, the bulky substituents on the olefin cause the polymer chain to be elongated and more effective in poisoning crystal growth. In contrast to the prior-art terpolymers discussed above, the polymer disclosed herein contains a critical amount of a substituted olefin which optimizes the cold flow properties. Polymers of this type, to the best of my knowledge, are not disclosed elsewhere. The unique polymers disclosed herein are polymers which improve the cold-flow properties of petroleum products in a more cost-efficient manner than prior-art terpolymers. Lesser amounts of these novel products than prior-art materials can be used to obtain simultaneously improved pour point, improved low-temperature flowability and improved cold-flow plugging point properties of a variety of fuels from a variety of sources. Terpolymer compositions comprising 0.1–10.0 moles or preferably 5.0–10.0 moles of ethylene per mole of unsaturated ester and 10–100 moles or preferably 40.0–70.0 moles of ethylene and unsaturated ester per mole of substituted olefin provide the maximum performance in providing exceptional low temperature-viscosity properties to the distillate.

The terpolymer can be produced by conventional gasor liquid- (solvent-) phase polymerization using conventional free-radical polymerization initiators such as benzoyl peroxide, tertiary butyl peroxide, ditertiary butyl peroxide, cumene peroxide, and other free-radical polymerization catalysts well-known in the art. The peroxide is used generally in a concentration of about 0.1 to about 10 weight percent and preferably 1 to 2 weight percent of the monomers.

Conventionally, a typical hydrocarbon polymerization solvent may be used, for example, benzene, cyclohexane, toluene, xylene, and other aromatic solvents. The polymerization temperature is generally within the range of about 150°–350° F. and preferably from about 175°–275° F. The pressure can be within the range of about 500 to about 3,000 psi absolute or more, preferably 800 to 1,500 psia. The polymerization is carried out until the polymerization is complete, generally from about 1 to 12 hours. Conventional gas- or liquid-phase polymerization techniques are used, but the ratios of reactants must be adjusted so that the required content of monomer units in the final product is achieved. The molecular weight of the polymer can range from about 500 to 50,000 or more, preferably from about 700 to about 5,000$\mu$, and more preferably from 800 to about 2,000. The tepolymer composition of this invention is an extremely effective pour point depressant.

The terpolymer is incorporated in the distillate fuel in a sufficient concentration to lower the four point of the hydrocarbon to a satisfactory degree. For economic reasons, additives are preferably used in minimum concentrations. The additive can be used satisfactorily in difficult-to-treat hydrocarbons in concentration from about 10 to about 2,500 parts per million based upon the total amount of hydrocarbon. Preferably, the polymer is used in the range of 10 to 500, most preferably 10 to 350, parts per million by weight of the hydrocarbon.

In general, the distillate fuel oils of this invention boil in a range between 250° and 900° F. and have a cloud point from about 0° to 45° F. The fuel oil can comprise straight run or cracked gas oil or a blend in any proportion of straight run or thermally cracked and/or catalytically cracked distillates, etc. The most common petroleum middle distillate fuels are kerosene, diesel fuels, jet fuels, and heating oils. A low-temperature-flow problem is most usually encountered with No. 1 and No. 2 diesel fuels and with No. 1 and No. 2 heating oils.

A typical heating oil specification calls for a 10 percent distillation point no higher than about 440° F., a 50 percent distillation point no higher than about 520° F., and a 90 percent distillation point at least 540° F. and no higher than about 640°–650° F., although some specifications set the 90 percent distillation point as high as 675° F. or higher. Other minor variations in the distillation points may occur. A typical specification for diesel fuels includes a minimum flash point of 100° F. and a 90 percent distillation point (ASTM D-110) between 540° F. and 640° F. (see ASTM designations D-496 and D-975). As discussed above, distillate fuels having specifications 50° F. higher than that shown above are being produced in Europe and potentially can be used in the United States.

The pour point depressant discussed herein can be used in conjunction with other additives normally incorporated in hydrocarbons which will improve other hydrocarbon properties. These additives include antioxidants, corrosion and rust inhibitors, viscosity index improvers, cetane improvers, metal deactivators, dyes, anti-microbial agents, detergents, etc.

The following examples, experiments, and test data are introduced to illustrate further the novelty and utility of the present invention, but are not intended to limit the invention.

Two methods of analysis used to evaluate the cold flow properties of the terpolymer are the ASTM D-97 Pour Point Test used in domestic testing of fuels for beneficial properties of additives and the Cold Flow Plugging Point Test used to test the European fuels having higher distillation end points. The Cold Flow Plugging Point Test (CFPPT) is carried out by the procedure described and detailed in *Journal of the Institute of Petroleum,* Vol. 52, No. 510, June 1966, pp. 173–185. In brief, the Cold Flow Plugging Point Test is carried out with a 45-milliliter sample of the oil to be tested which is cooled in a bath maintained at about −34° C. Upon every one degree drop in temperature starting from 2° C. above the cloud point, the oil is tested with a test device consisting of a pipette on whose lower end is attached an inverted funnel. Stretched across the mouth of the funnel is a 350-mesh screen having an area of about 0.45 square inch. A vacuum of about 8 inches of water is applied to the upper end of the pipette by means of a vacuum line while the screen is immersed in the oil sample. Oil is drawn by the vacuum through the screen into the pipette to a mark indicating 20 milliliters of oil. The test is repeated at each 1° C. drop in temperature until the clogging of the screen by wax crystals prevents the oil from filling the pipette to the aforesaid mark. The results of the test are reported as the centigrade temperature at which the oil fails to fill the pipette in the prescribed time.

EXAMPLE I

Into a one-liter stirred autoclave equipped with a heater and solution injectors were charged 400 milliliters of cyclohexane reaction solvent. The autoclave was purged first with nitrogen and then with ethylene at ambient temperature. The autoclave was heated to 100° C. Ethylene was introduced until the pressure within the autoclave reached 900 psig at 100° C. Into the pressurized, heated and stirred autoclave were charged 120 milliliters of a solution containing 45 grams (0.53 mole) of vinyl acetate and 3.3 grams (0.059 mole) of isobutylene in cyclohexane at the rate of 1 milliliter per minute. Simultaneously, 120 milliliters of a solution of 0.3 gram (0.002 mole) benzoyl peroxide in cyclohexane were injected at the rate of 1 milliliter per minute. The addition of the monomer and the initiator took two hours. After the addition of the monomers, the autoclave was stirred at 800 psig for two hours, and then was cooled to room temperature and depressurized. The polymer in cyclohexane was recovered and stripped of solvent and unreacted monomers under vacuum over a steam bath. The polymerization yielded 21.0 grams of polymer.

EXAMPLE II

Into a one-liter stirred autoclave equipped with solution injectors were charged 400 milliliters of cyclohexane. The autoclave was purged with nitrogen and then with ethylene at ambient temperature and was heated to 120° C. and pressurized with ethylene to an initial reaction pressure of 1,375 psig. Into the pressurized, heated and stirred autoclave was injected a solution of 55.7 grams (0.65 mole) of vinyl acetate and 3.3 grams (0.029 mole) of 2,4,4-trimethyl-1-pentene (diisobutylene isomer) in 120 milliliters of cyclohexane at an injection rate of 1 milliliter per minute. Simultaneously with the addition of the polymer solution, a solution of 0.3 gram (0.002 mole) of benzoyl peroxide in 60 milliliters of cyclohexane was injected at a rate of 1 milliliter per hour. After the addition of the monomer, the autoclave was maintained at 120° C. for an additional 60 minutes. The reactor was depressurized and the contents were stripped of volatiles. The polymerization yielded 20.2 grams of polymer.

EXAMPLE III

Example II was repeated, except that the initial reaction pressure was 1,450 psig instead of 1,375 psig and the olefin polymerized in the reaction was 2,4,4-trimethyl-2-pentene (diisobutylene isomer) instead of 2,4,4-trimethyl-1-pentene. The polymerization yielded 14.0 grams of polymer.

EXAMPLE IV

Example I was repeated, except that the initial reaction pressure was 1,000 psig instead of 800 psig and the monormer solution contained 56.3 grams (0.65 mole) of vinyl acetate and 3.3 grams (0.29 mole) of a mixture of diisobutylene isomers, instead of 45.0 grams of vinyl acetate and 3.3 grams of isobutylene, in 120 milliliters of cyclohexane. The yield of the polymerization was 36.5 grams.

EXAMPLE V

Example I was repeated, except that the initial reaction pressure was 1,400 psig instead of 800 psig and the monomer solution contained 10.0 grams (6.059 moles) of a mixture of triisobutylene isomers instead of 3.3 grams of isobutylene. The yield of the polymerization was 22.3 grams.

EXAMPLE VI

Example I was repeated, except that the initial reaction pressure was 1,550 psig instead of 800 psig and the monomer solution contained 56.5 grams of vinyl acetate and 4.25 grams of 2-methyl-4-phenyl-1-butene in 120 milliliters of cyclohexane instead of 45.0 grams of vinyl acetate and 3.3 grams of isobutylene. The yield of the polymerization was 26.7 grams of polymer.

TABLE I

Characterization of Ethylene—Vinyl Acetate-Substituted Olefin Terpolymers

| Polymer Example | Substituted Olefin | Vinyl Acetate wt. % (moles per mole of ethylene and olefin) | Substituted Olefin wt. % (moles per mole of ethylene and unsubstituted ester) |
|---|---|---|---|
| I | isobutylene | 28 (0.13) | — |
| II | 2,4,4-trimethyl-1-pentene | 29 (0.13) | — |
| III | 2,4,4-trimethyl-2-pentene | 30 (0.14) | — |
| IV | diisobutylene | 28 (0.13) | — |
| V | triisobutylene | 26 (0.11) | — |
| VI | 2-methyl-4-phenyl-1-butene | 26.5 (0.13) | 7.3 (0.02) |

| Polymer Example | Substituted Olefin | Estimated Ave. M.W. | Ave. M.W. Polydispersion |
|---|---|---|---|
| I | isobutylene | 1200 | 1.5 |
| II | 2,4,4-trimethyl-1-pentene | 1250 | 1.8 |
| III | 2,4,4-trimethyl-2-pentene | 1250 | 1.9 |
| IV | diisobutylene | 1500 | 1.9 |
| V | triisobutylene | 875 | 2.1 |
| VI | 2-methyl-4-phenyl-1-butene | 1400 | 2.4 |

TABLE II

Performance of Ethylene—Vinyl Acetate-Substituted Olefin Terpolymers

| Polymer Example (Substituted Olefin) | Polymer Concentration (ppm) | Pour Point (°C.) in Various Fuels | | | |
|---|---|---|---|---|---|
| | | R-53 | 60/40T | LB-1420 | Texaco Ghent |
| I | 100 | −9 | −30 | −21 | −21 |
| (isobutylene) | 200 | −15 | −33 | −27 | −27 |
| II | 100 | −9 | −30 | −21 | −18 |
| (2,4,4-trimethyl-1-pentene) | 200 | −12 | −36 | −27 | −21 |
| III | 100 | −12 | −27 | −24 | −21 |
| (2,4,4-tri pentene) | 200 | −15 | −33 | −24 | −27 |
| IV | 100 | −9 | −24 | −18 | −21 |
| (diisobutylene isomers) | 200 | −12 | −33 | −21 | −24 |
| V | 100 | −9 | −30 | −18 | −21 |
| (triisobutylene isomers) | 200 | −12 | −36 | −24 | −24 |
| No Polymer (blank) | | −9 | −15 | −12 | −12 |

TABLE III

| Polymer Example (Substituted Olefin) | Polymer Concentration ppm | Cold-Flow Plugging Point In Various Fuels | |
|---|---|---|---|
| | | LB-1420 | Texaco Ghent |
| I | 100 | −18 | −13 |
| (isobutylene) | 200 | −22 | −16 |
| II | 100 | −24 | −13 |
| (2,4,4-trimethyl-1-pentene) | 200 | −26 | −17 |
| III | 100 | −22 | −12 |
| (2,4,4-trimethyl-2-pentene) | 200 | −24 | −15 |

TABLE III-continued

| Polymer Example (Substituted Olefin) | Polymer Concentration ppm | Cold-Flow Plugging Point In Various Fuels | |
|---|---|---|---|
| | | LB-1420 | Texaco Ghent |
| IV | 100 | −20 | −14 |
| (diisobutylene isomers) | 200 | −21 | −16 |
| V | 100 | −18 | −16 |
| (triisobutylene isomers) | 200 | −21 | −21 |
| No Polymer (blank) | — | −10 | −9 |

An examination of Table I shows the characterization of the polymer in terms of composition of monomer molecular weight and polydispersion. Tables II and III show that the polymers attain excellent improvement in the cold-flow properties of distillate fuels.

The above discussion, examples, and experiments illustrate specific embodiments of the invention. However, since many modifications and alterations in the terpolymer and its application can be made without diverting from the invention, the invention resides wholly in the claims appended hereinafter.

I claim:

1. A distillate fuel composition having improved cold-flow plugging point and improved pour point properties comprising a distillate fuel and about 10–2,500 parts of an ethylene-unsaturated, ester-substituted olefin terpolymer per million parts of the distillate fuel, wherein the unsaturated ester comprises vinyl acetate and the substituted olefin comprises 2,4,4-trimethyl-1-pentene, 2,4,4-trimethyl2-2-pentene, 2,4,4,6,6,-pentamethyl-1-heptene, 2,4,4,6,6,-pentamethyl-2-heptene, cis- or trans-,2,24,6,6-pentamethyl-3-heptene, 2-neopentyl-1-pentene or mixtures thereof.

2. The composition of claim 1 wherein the ethylene-unsaturated, ester-substituted olefin comprises about 0.1–10.0 moles of ethylene per mole of vinyl acetate and about 10–100 moles of ethylene and vinyl acetate combined per mole of substituted olefin.

3. The composition of claim 1 wherein the ethylene-unsaturated ester-substituted olefin comprises about 5.0–10.0 moles of ethylene per mole of vinyl acetate and about 40.0–70.0 moles of ethylene and vinyl acetate combined per mole of 2,4,4-trimethyl-1-pentene, 2,4,4-trimethyl-2-pentene, 2,4,4,6,6-pentamethyl-1-heptene, 2,4,4,6,6-pentamethyl-2-heptene, cis- or trans-2,2,6,6-pentamethyl-3-heptene, 2-neopentyl-4,4-dimethyl-1-pentene, or mixtures thereof.

* * * * *

UNITED STATES PATENT OFFICE
CERTIFICATE OF CORRECTION

Patent No. 4,746,327 Dated May 24, 1988

Inventor(s) G. L. Smyser

It is certified that error appears in the above-identified patent and that said Letters Patent are hereby corrected as shown below:

Column 1, line 22, "year." should be --years.--

Column 1, line 34, "for" should be --or--

Column 4, line 21, "pentamethyl(2" should be --pentamethyl-2--

Column 5, line 48, "5,000u" should be --5,000--

Column 5, line 49, "tepolymer" should be --terpolymer--

Column 5, line 52, "four" should be --pour--

Column 5, line 56, "in concentration" should be --in a concentration--

Column 7, line 45, "monormer" should be --monomer--

Column 10, line 8, "2,4,4-trimethyl2-2" should be --2,4,4-trimethyl-2--

Column 10, line 9, "2,4,4,6,6,-" should be --2,4,4,6,6- --

Column 10, line 9, "2,4,4,6,6,-" should be --2,4,4,6,6- --

Column 10, line 10, "trans-,2,24,6,6-" should be --trans-2,2,4,6,6- --

Column 10, line 23, "trans-2,2,6,6-" should be --trans-2,2,4,6,6- --

UNITED STATES PATENT AND TRADEMARK OFFICE

CERTIFICATE OF CORRECTION

PATENT NO. : 4,746,327

DATED : May 24, 1988

INVENTOR(S) : G.L. Smyser

It is certified that error appears in the above-identified patent and that said Letters Patent is hereby corrected as shown below:

Column 10, line 23, "trans-2,2,6,6-" should be --trans-2,2,4,6,6- --.

Signed and Sealed this

Eighth Day of November, 1988

*Attest:*

DONALD J. QUIGG

*Attesting Officer*

*Commissioner of Patents and Trademarks*